US012593932B2

(12) United States Patent
Maddux

(10) Patent No.: US 12,593,932 B2
(45) Date of Patent: Apr. 7, 2026

(54) FRAMED IMAGE RETENTION DEVICE AND METHOD OF USE

(71) Applicant: Candi D Maddux, Olathe, KS (US)

(72) Inventor: Candi D Maddux, Olathe, KS (US)

( * ) Notice: Subject to any disclaimer, the term of this patent is extended or adjusted under 35 U.S.C. 154(b) by 86 days.

(21) Appl. No.: 18/652,190

(22) Filed: May 1, 2024

(65) Prior Publication Data

US 2024/0365998 A1 Nov. 7, 2024

Related U.S. Application Data

(60) Provisional application No. 63/463,102, filed on May 1, 2023.

(51) Int. Cl.
*A47G 1/06* (2006.01)

(52) U.S. Cl.
CPC ..... *A47G 1/06* (2013.01)

(58) Field of Classification Search
CPC ..... A47G 2001/0677; A47G 1/06–2001/148
USPC ..... 410/149; 248/200.1; 211/105.5; 40/790, 40/795, 792
See application file for complete search history.

(56) References Cited

U.S. PATENT DOCUMENTS 648,523 A * 5/1900 Pierce ..... A47G 1/06 40/795
1,742,378 A * 1/1930 Boese ..... A47G 1/06 40/792
2,337,517 A * 12/1943 Wotton ..... G09F 1/10 40/646
3,593,857 A * 7/1971 Hernes ..... A47F 11/02 428/101
4,258,492 A * 3/1981 Williams ..... G09F 21/04 40/591
2021/0070098 A1* 3/2021 van Os ..... G09F 7/18

* cited by examiner

*Primary Examiner* — Cassandra Davis
(74) *Attorney, Agent, or Firm* — AVEK IP, LLC

(57) ABSTRACT

A retention device for framed items. The retention device includes a pair of ends with caps intended to sit within the corners of a frame. These caps are pressed up against the corners of the frame and are held in place using springs or other retractable forces to ensure that the retention device remains in place until selectively removed by the user. A central bridge connects the caps and provides the outward force to secure the device within the frame.

1 Claim, 7 Drawing Sheets

FRAMED IMAGE RETENTION DEVICE AND METHOD OF USE

CROSS-REFERENCE TO RELATED APPLICATION

This application claims priority in U.S. Provisional Patent Application No. 63/463,102, Filed May 1, 2023, which is incorporated herein by reference.

BACKGROUND OF THE INVENTION

1. Field of the Invention

The present invention relates generally to an image retention device and method for use thereof, and more specifically to a universal framed image retention device for use in picture frames or other displays.

2. Description of the Related Art

Displaying photographs, art work, and other items in frames is a very common practice. Typically, frames come with backboards which are secured behind framed items to hold them into place. These backboards may not function with all framed items, may become damaged or lost, or otherwise are cumbersome to place and remove on a frame to change out images. What is needed is a universal, fast, reusable device for securing items within a frame.

Heretofore there has not been available a system or method for a framed image retention device with the advantages and features of the present invention.

BRIEF SUMMARY OF THE INVENTION

The present invention generally provides a retention device for framed items. The retention device includes a pair of ends with caps intended to sit within the corners of a frame. These caps are pressed up against the corners of the frame and are held in place using springs or other retractable forces to ensure that the retention device remains in place until selectively removed by the user.

In a preferred embodiment, the device may include a central bridge which has a pair of ends, and a spring located at each end. One of the clips are affixed to each end such that pressing against each clip depresses a respective one of the springs, and upon release the spring pushes the clip outwards. In this manner, the clip is pressed up against the corner of a frame by the spring.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
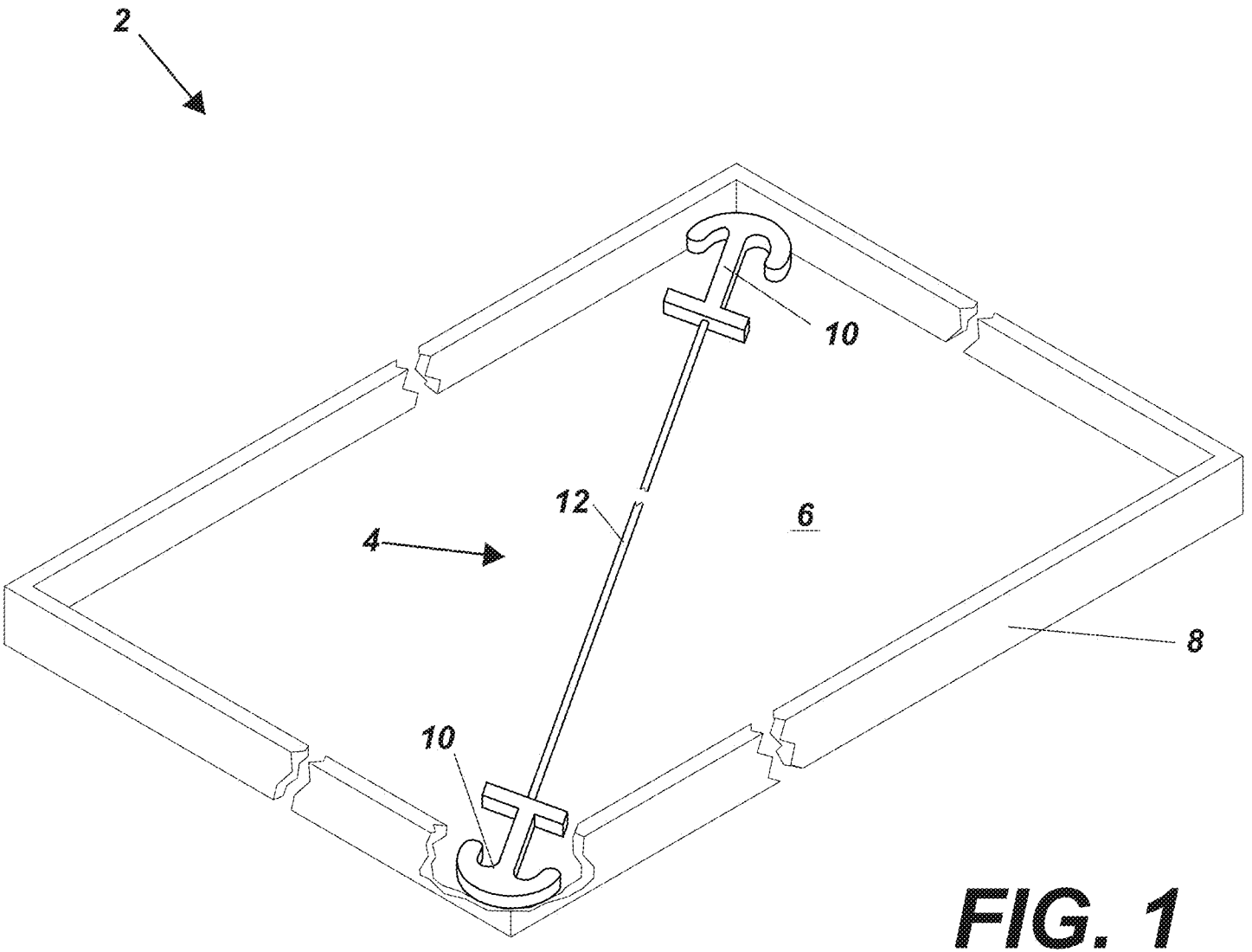
FIG. 1 is a three-dimensional isometric view of a preferred embodiment of the present invention shown in a typical environment of a frame.
Figure 2:
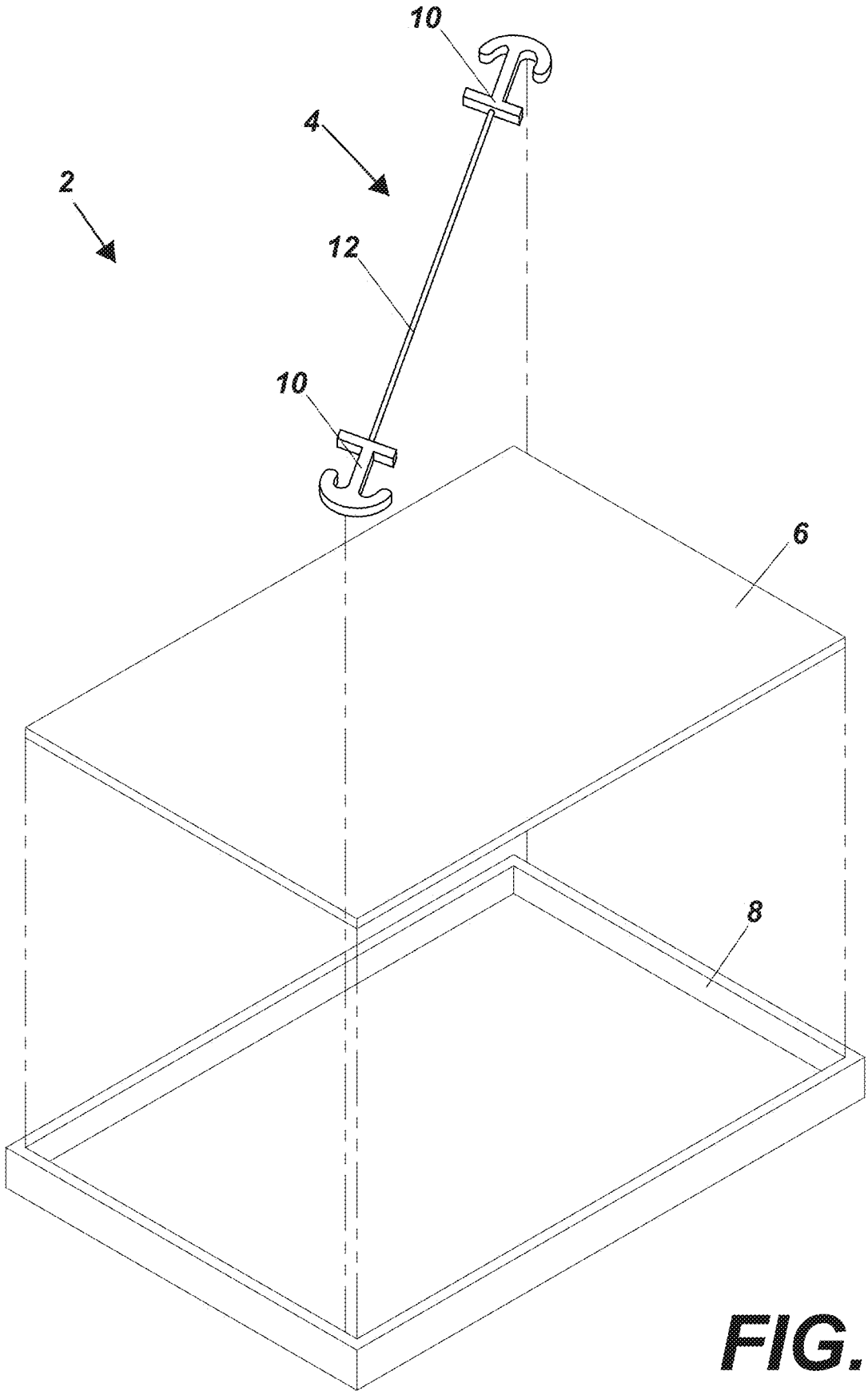
FIG. 2 is a partially exploded three-dimensional isometric view thereof.
Figure 3:
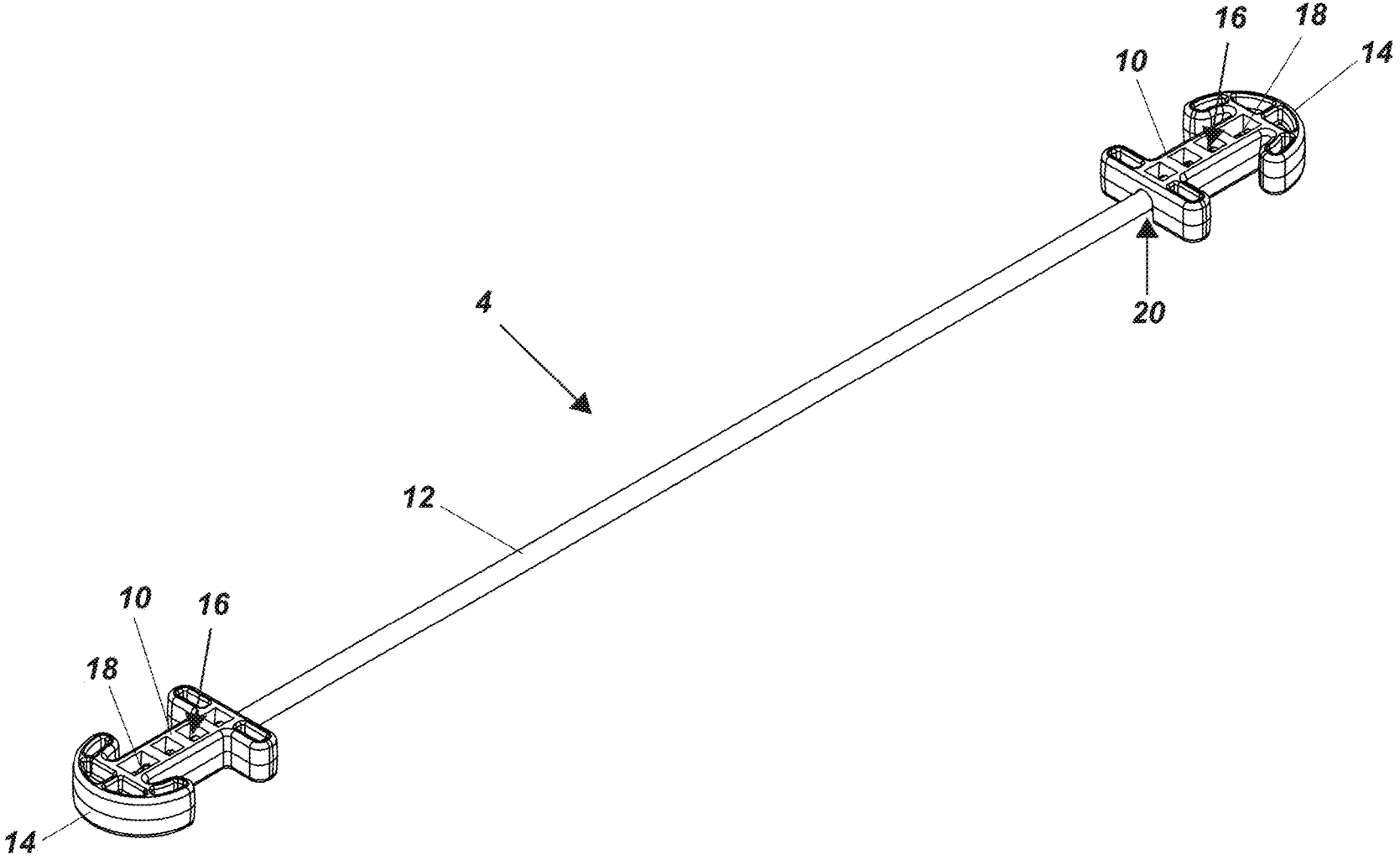
FIG. 3 is a three-dimensional isometric view of the embodiment thereof shown from a top face.
Figure 4:
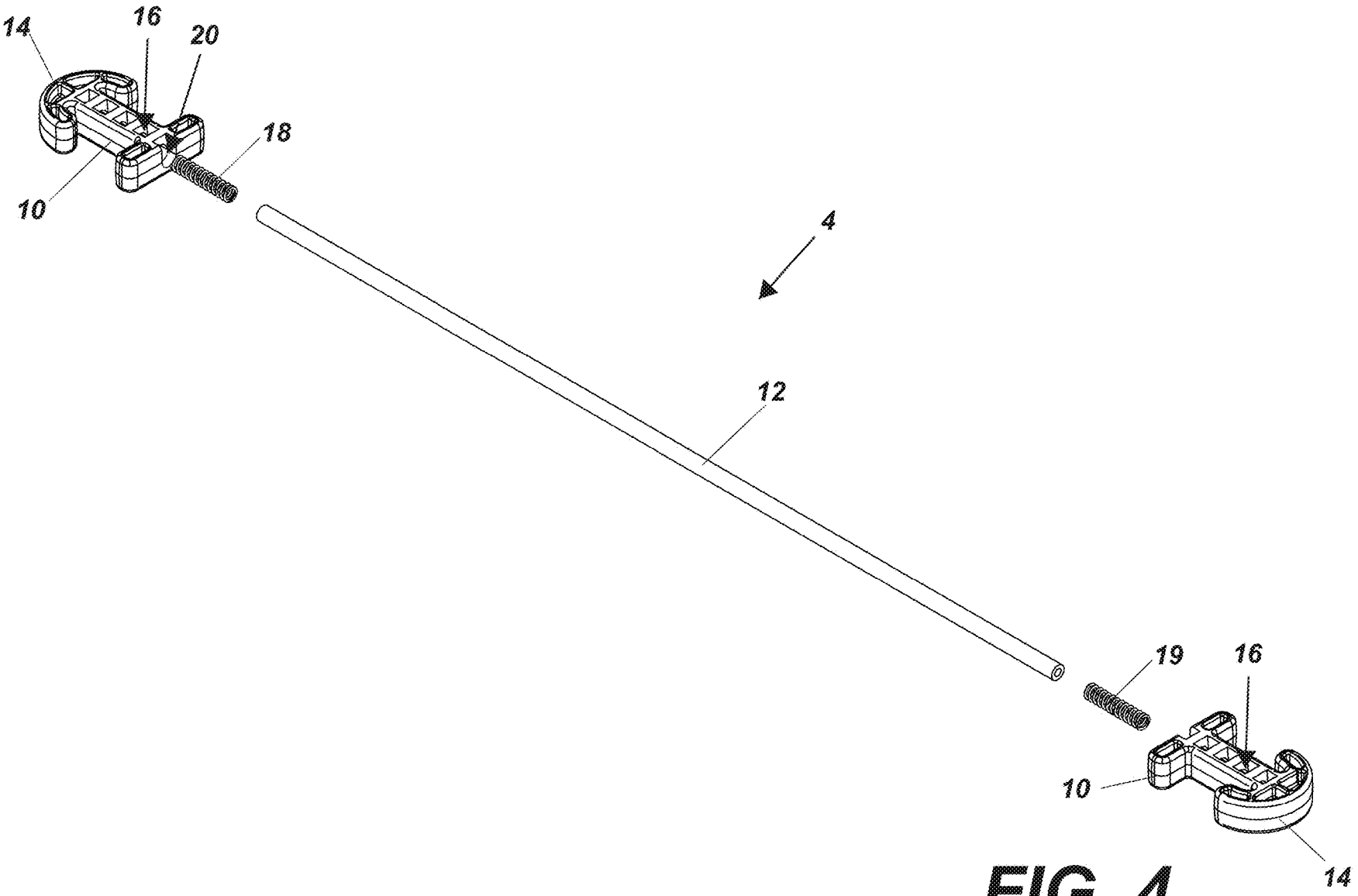
FIG. 4 is an exploded three-dimensional isometric view thereof.
Figure 5:
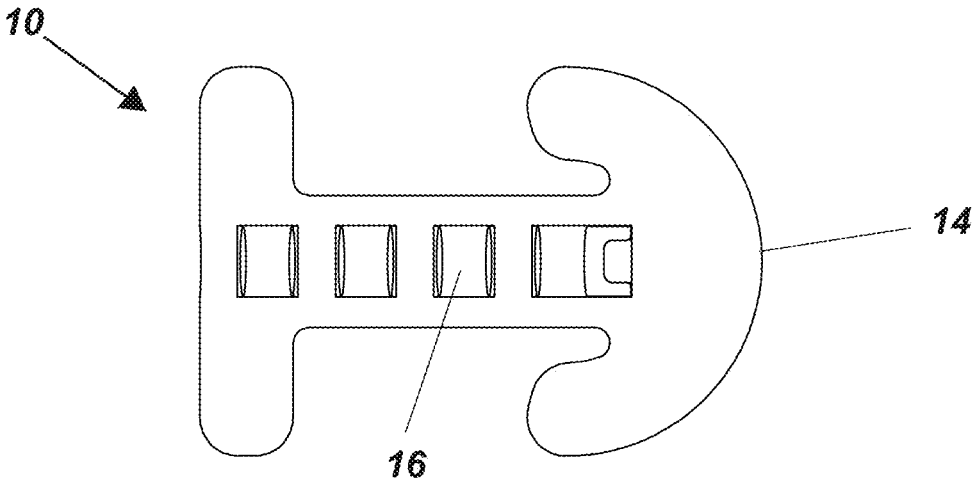
FIG. 5 is a top plan view of an end cap element thereof.
Figure 6:
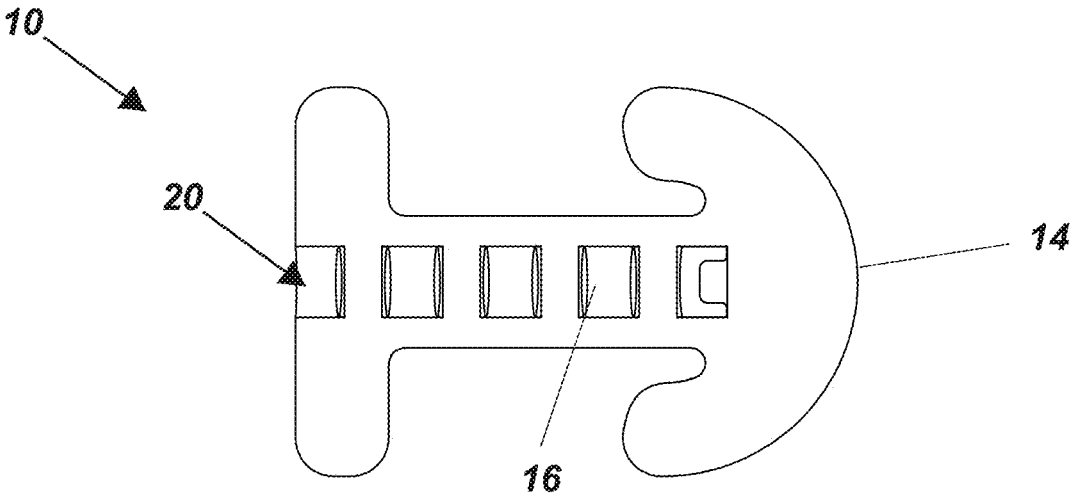
FIG. 6 is a bottom plan view thereof.
Figure 7:
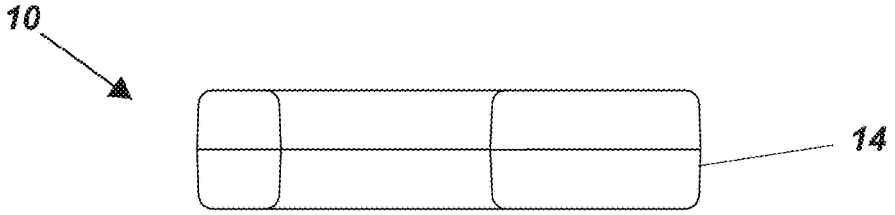
FIG. 7 is a right-side elevational view thereof.
Figure 8:
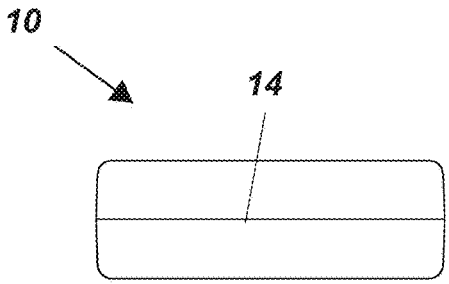
FIG. 8 is a front elevational view thereof.
Figure 9:
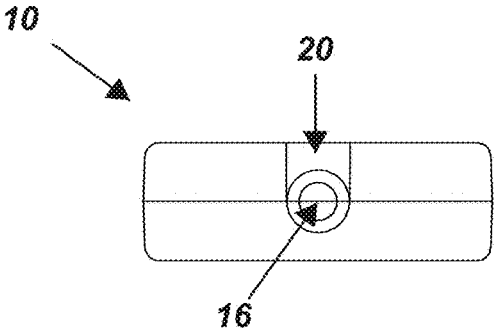
FIG. 9 is a rear elevational view thereof.
Figure 10:
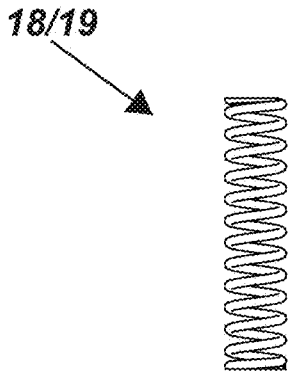
FIG. 10 is a top plan view of a spring element thereof.
Figure 11:
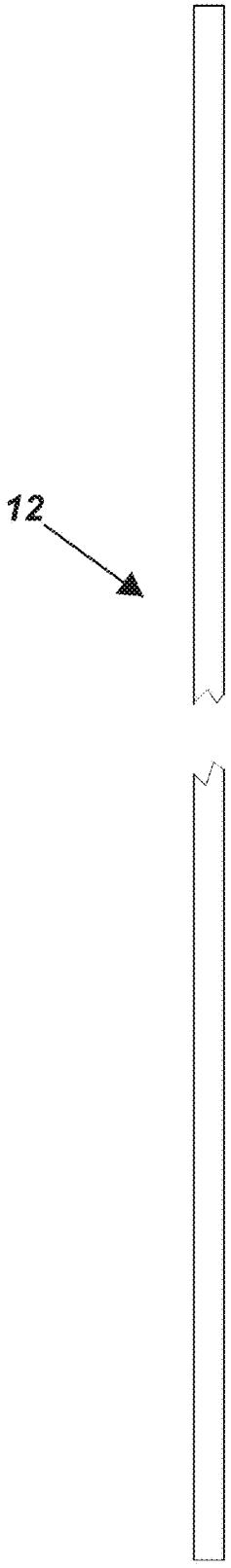
FIG. 11 is a top plan view of a bridge element thereof.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Retention Device 4 for a Frame System 2

As shown in FIGS. 1-11, the present invention is a frame system 2 which uses universal retention device 4 intended to fit within a frame 8 to secure images 6 therein. The device has a central bridge 12 which can be formed from a tube having a first end and a second end. The first end secures a first spring 18 and the second end secures a second spring 19.

A first end cap 10 is affixed to the first end, such that when depressed the first spring 18 is depressed, and when released the first spring 18 presses the first cap 10 outwards towards the edge of a picture frame as shown in FIG. 1. Similarly, a second cap 10 is affixed to the second end is similarly spring-mounted to the frame via the second spring 19. Each cap 10 has a tip 14, which may be rounded as shown to fit oddly shaped frame corners without damaging any frames. The springs are retained within a hollow interior 16 of each end cap.

Each end cap 10 may include a notch 20 to make it easier to reassemble the device and insert the bridge 12 into the end cap 10.

This retention device 4 provides a universal securing device for frames 8 of varying sizes and shapes. The device can quickly be disconnected to allow for the changing of the framed item within the frame.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A framed item retention system comprising:

a retention device comprising a central bridge having a first end and a second end;

a first spring connected to said first end and a first cap such that when said first cap is depressed, said first spring is depressed, and when said first cap is released, said first spring presses said first cap outwards along an axis running centrally along said central bridge;

a second spring connected to said second end and a second cap such that when said second cap is depressed, said second spring is depressed, and when said second cap is released, said second spring presses said second cap outwards said an axis running centrally along said central bridge;

each of said first cap and said second cap comprising a rounded tip;

a frame comprising an interior space, said interior space of said frame configured to receive and to store an image;

wherein said first cap and said second cap are configured to be removably engaged with respective first and second interior corners of said frame; and wherein said retention device is configured to secure said image contained within a flat medium within said frame while remaining selectively removable.

* * * * *